United States Patent [19]

Shimada et al.

[11] Patent Number: 4,960,099

[45] Date of Patent: Oct. 2, 1990

[54] DISTRIBUTOR FOR INTERNAL COMBUSTION ENGINE

[75] Inventors: Junichi Shimada, Hitachi; Kazutoshi Kobayashi, Katsuta; Norio Moriyama, Katsuta; Kazuhiko Kawakami, Katsuta, all of Japan

[73] Assignee: Hitachi, Ltd., Tokyo, Japan

[21] Appl. No.: 404,640

[22] Filed: Sep. 8, 1989

[30] Foreign Application Priority Data

Sep. 19, 1988 [JP] Japan ..... 63-232508

[51] Int. Cl.[5] ..... F02P 7/00

[52] U.S. Cl. ..... 123/647; 123/612; 123/634; 123/635; 123/146.5 A

[58] Field of Search ..... 123/647, 612, 613, 617, 123/634, 635, 146.5 A

[56] References Cited

U.S. PATENT DOCUMENTS

| | | | |
|---|---|---|---|
| 3,795,236 | 3/1974 | Jukes et al. | 123/634 |
| 4,224,917 | 9/1980 | Nakazawa et al. | 123/647 |
| 4,365,609 | 12/1982 | Toyama et al. | 123/617 |
| 4,485,796 | 12/1984 | Boyer | 123/617 |
| 4,677,946 | 7/1987 | Tamagne | 123/617 |

FOREIGN PATENT DOCUMENTS

| | | | |
|---|---|---|---|
| 3837568 | 5/1989 | Fed. Rep. of Germany | 123/146.5 A |
| 45-26527 | 9/1970 | Japan . | |
| 56-557 | 1/1981 | Japan | 123/146.5 A |

*Primary Examiner*—Andrew M. Dolinar

*Attorney, Agent, or Firm*—Antonelli, Terry, Stout & Kraus

[57] ABSTRACT

A distributor for an internal combustion engine has a housing, a shaft inserted in the housing, a head mounted on the shaft, a cap attached to the housing so as to cover the rotor head, a signal detector accommodated in the housing, a connector projecting outside the housing, and an ignition coil accommodated in the housing. The housing has a cut-out portion formed in a side wall thereof from an abutment between the cap and the housing and extending toward the bottom of the housing for receiving the connector, and the cap and the connector are tightly engaged with the housing through a gasket. Silicon rubber is charged in the gap between the housing and the ignition coil. A heat release plate may be provided between the housing and the signal detector so that a path formed by the plate and the housing and surrounding a section of the core is electrically cut off, whereby no current flows in the path.

12 Claims, 8 Drawing Sheets

DISTRIBUTOR FOR INTERNAL COMBUSTION ENGINE

BACKGROUND OF THE INVENTION

The present invention relates to a distributor of the type which is employed in an electric ignition system of a multi-cylinder internal combustion engine and, more particularly, to a distributor for an internal combustion engine which is improved in both reliability and durability.

In general, a distributor for internal combustion engines comprises a housing, a shaft inserted in the housing and mounted to rotate synchronously with the crankshaft of the engine, a rotor head attached to an end of the shaft to distribute electric current, and a cap for closing the housing and having electrodes for inputting electric current to the rotor head and for outputting a distribution electric current. Such a distributor also may accommodate a signal detector and other electrical devices inside the housing in order to reduce the overall size of an internal combustion engine and accommodate other devices in available spaces within the distributor rather than on the internal combustion engine. Japanese Patent Publication No. 45-26527/1970 discloses one example of this type of distributor. It is necessary, in order to accommodate various kinds of electrical devices inside the distributor housing, to give special consideration to the waterproofness, heat resistance, etc. of the distributor housing.

One of the problems concerning waterproofness relates to the fact that it is difficult to provide both for waterproofness and ease of assembly of the distributor.

The signal detector installed inside the housing of a distributor is provided with a connector inserted in an opening formed in the side wall of the housing so as to project outside of the housing. The connector is fixed to the housing by screws through an annular rubber gasket fitted on the connector. However, this structure needs a large number of components and therefore provides for difficulties in assembly of the distributor.

The above-mentioned structure for enhancing waterproofness gives rise to a problem that dissipation of heat generated inside the housing is likely to be obstructed. In the distributor in which an ignition coil is accommodated inside the housing, the heat resistance of the ignition coil must be enhanced.

However, the improvement in heat resistance that is attained simply by enhancing the heat resistance of the constituent material is limited and it is therefore necessary to improve the heat resistance by enhancing both suppression of heat generation and dissipation of heat.

In the distributor in which an ignition coil is accommodated, a core of the ignition coil and the housing are in contact with each other through a seat; however, the area for heat transfer is relatively small and therefore dissipation of heat through conduction at the seat does not satisfactorily take place. Further, there is a problem of generation of heat from the ignition coil.

In order to increase the efficiency of dissipation of heat from electrical devices, a heat dissipating plate has been provided between the signal detector and the housing and is fastened to the housing together with the signal detector by means of fastening screws.

In this prior arrangement, one of the fastening screws is disposed in such a manner as to be inserted into the annular core, while the other screw is disposed outside the core. Accordingly, a short-circuit is formed by a part of the housing and the heat dissipating plate in such a manner as to surround the cross-section of the core (i.e., in such a manner as to link up with the annular core in the form of a chain), resulting in a short-circuit current flowing. Thus, there is an energy loss due to the resistance component of the short-circuit, which results in a reduction in the energy generated in the secondary winding of the ignition coil. In addition, part of the energy thus lost is consumed in the heat dissipating plate, thus causing an additional rise in temperature.

SUMMARY OF THE INVENTION

An object of the present invention is to provide a distributor for internal combustion engines having superior assembleability and excellent waterproofness.

Another object of the present invention is to provide a distributor in which heat generation due to electromagnetic induction in the ignition coil is prevented.

Further, another object of the present invention is to provide a distributor which provides an improvement in dissipation of heat generated from the ignition coil.

According to the present invention, in a distributor for an internal combustion engine comprising a housing having a bottom, an open end and a side wall between the bottom and the open end, a shaft inserted in the housing and mounted to rotate synchronously with an engine crankshaft, a rotor head mounted on the shaft, a cap attached to the housing so as to cover the rotor head, and a signal detector accommodated in the housing and having a connector projecting outside the housing, an opening for allowing the connector to project outside the housing is formed in the side wall of the housing so that when the cap is removed, the connector is attached or removed through movement of the connector along the side wall, and the connector is pressed between the housing and the cap through a gasket which also provides a seal between the housing and cap.

More specifically, a U-shaped cut off portion which is provided in the housing is covered with the lower side of the cap so as to operate in the same manner as that of an opening having a rectangular cross-sectional configuration.

With this construction, when the housing and the cap are secured to each other and the connector is clamped between the cut-out portion and the cap, the cut-out portion functions in the same way as that of the opening; whereas, when the cap is removed from the housing, the connector can be readily removed and attached through the cut-out portion. Thus, the assembly of the distributor is facilitated.

When the present invention is carried out, if the two sides of the cut-out portion at the mouth thereof are tapered such that the inner part of the cut-out portion is narrower, the assembly operation is further facilitated and it is also possible to bring the connector into close contact with the housing side wall at the cut-out portion.

According to an aspect of the present invention, in a distributor in which an ignition coil is incorporated in the housing, an electric current path formed by the housing and a heat release or dissipation plate for releasing heat generated by electric devices incorporated in the housing is electrically cut-off at any one or more points, whereby electric current is not induced in the path.

According to another aspect of the present invention, the path above mentioned is constructed so as to include two cross-sectional portions of the core so that the directions of magnetic fluxes in the two portions of the core are opposite to each other and, therefore, no induced current flows.

According to another aspect of the present invention, a material having good thermal conductivity is charged in the gap between the ignition coil and the housing. As the above-described material, it is preferable to employ a fluid silicon rubber which can be solidified. The gap between the ignition coil and the housing is filled with a material having good thermal conductivity, so that the transfer of heat from the ignition coil to the housing is promoted.

DESCRIPTION OF THE PREFERRED EMBODIMENTS

An embodiment of the present invention will be described hereunder in detail referring to FIGS. 1 to 3.

Figure 1:
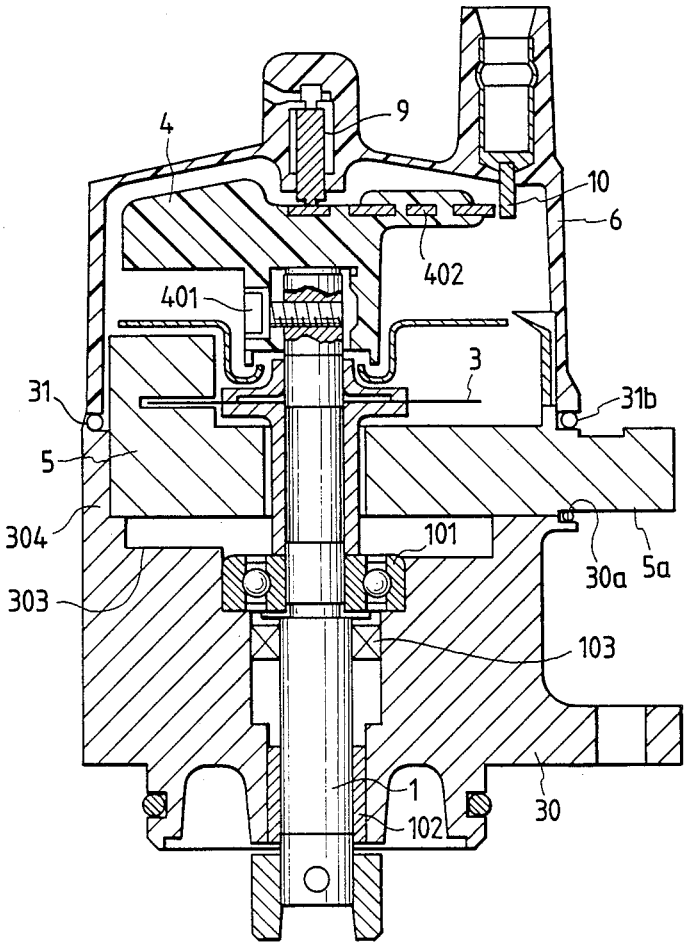
FIG. 1 is a longitudinal sectional view of an embodiment of distributor for an internal combustion engine according to the present invention.

In FIG. 1 a distributor for an internal combustion engine, comprises a housing 30, a shaft 1 rotatably supported by the housing 30 through bearings 101, 102 and driven by a crankshaft (not shown), a signal rotor 3 mounted on the shaft 1, a rotor head 4 secured to a top end of the shaft 1 by means of a screw 401, a cap 6 fitted to the housing 30 to provide a space therein for accommodating various parts, such as the rotor head 4, the signal rotor 3, etc. and a signal detection device or signal detector 5 accommodated in the housing 30. A sealing ring 103 is provided between the housing 30 and the shaft 1 for securing a waterproof seal therebetween. The cap 6 has a central electrode 9 in contact with an electrical conductor 402 of the rotor head 4 and a cap side electrode 10 facing an end of the electrical conductor 402 with a gap.

Figure 2:
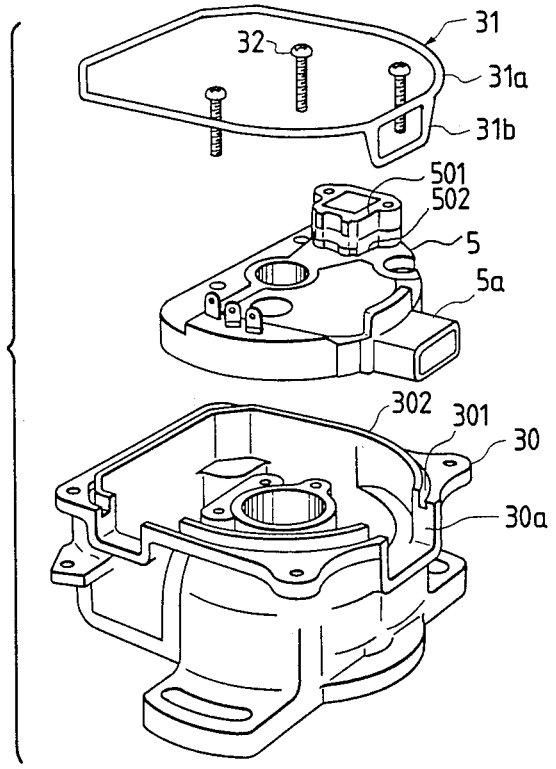
FIG. 2 is a perspective view of parts used in the distributor as shown in FIG. 1.

As seen in FIG. 2, the signal detection device 5 includes a light emission element 501, a light receiving element 502 and a connector 5*a* and is fixed to the housing 30 by screws 32. A light emitted from the light emission element 501 is sent to the light receiving element 502 through the signal rotor 3 so that the light is interrupted according to the rotation of the signal rotor 3 thereby to generate an ignition timing signal for the internal combustion engine. The signal is transferred to a control unit (not shown) through the connector 5*a*.

Referring again to FIG. 1, the housing 30 comprises a bottom portion 303, and a side wall portion 304 extending perpendicular to the bottom portion 303. The side wall portion 304 has an open end 302 as seen in FIG. 2 and a substantially rectangular cut-out opening in a part 30*a* of the side wall portion 304. A notch 301 is formed at the open end 302 and a peripheral portion of the cut-out portion 30*a* for receiving a gasket 31. The gasket 31 is formed of a material having significant elasticity, such as rubber, and has a large-diameter annular portion 31*a* having the same diameter as the notch 301 of the housing 30 and a small-diameter annular portion 31*b* which extends perpendicularly to a plane on which the large-diameter annular portion 31*a* is disposed, and is to be mounted on the connector 5*a* and fitted in the notch of the cut-out portion 30*a*.

The connector 5*a*, having the small-diameter annular portion 31*b* of the gasket 31 fitted thereon, is assembled into the housing 30 from the upper side, as viewed in FIG. 2. The signal detector 5 is secured to the housing 30 by means of fastening screws 32, the gasket 31 is fitted in the notch 301 of the housing 30, and then the cap 6 is mounted on the gasket 31 and fastened by fastening screws (not shown), whereby the gasket 31 is pressed on the housing 30 by an opening end face of the cap 6, and the cap 6 is sealingly secured to the housing 30, thus completing the assembly.

As mentioned above, the assembly is effected by a simple operation and is sufficiently waterproof.

Figure 3:
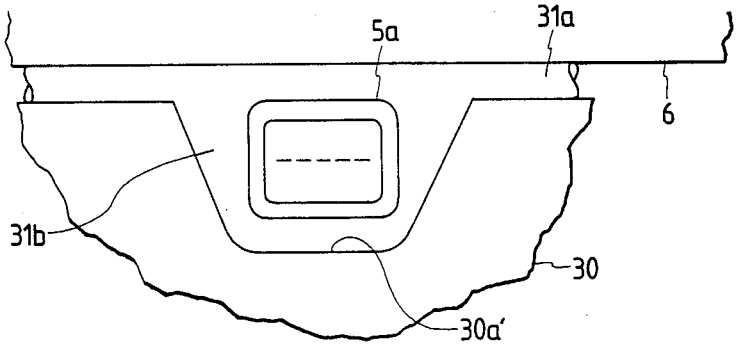
FIG. 3 is a front view showing a modification of a part of the distributor as shown in FIGS. 1 and 2.
Figure 4A:
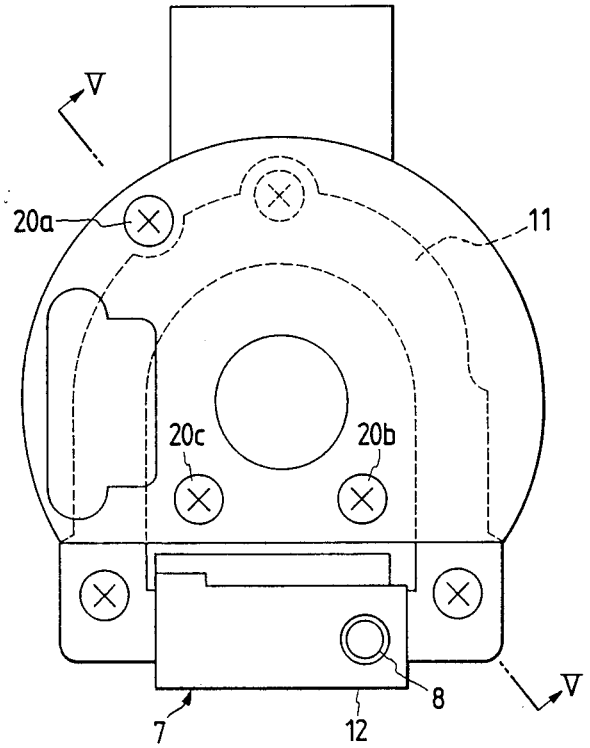
FIG. 4*a* is a plane view of another embodiment of a distributor for an internal combustion engine according to the present invention.
Figure 4B:
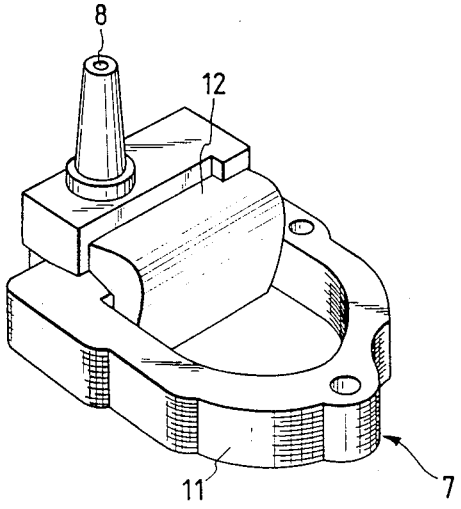
FIG. 4*b* is a perspective view of an ignition coil employed in the distributor shown in FIG. 4*a;*

FIG. 3 shows a modification of a sealing part of the distributor.

A cut-out portion 30*a'* of the housing side wall has two sides thereof which are tapered in such a manner that the mouth of the cut-out portion 30*a'* is wider than the bottom. The gasket has a large diameter portion 31*a* and small diameter portion 31*b*, and the small diameter portion 31*b* also has a shape similar to that of the cut-out portion 30*a*This construction makes it possible to assemble a signal detection device having a gasket mounted on the connector into the housing.

Another embodiment of the present invention will be described with reference to FIGS. 4*a* to 6.

A distributor shown in FIGS. 4*a* to 6 has an ignition coil 7 partially enclosed in a housing 2. As shown in FIG. 4*b*, the ignition coil 7 comprises an annular core 11, a coil 12 wound around a part of the core 11, and an electrode 8 electrically connected to the coil 12. The distributor also has a signal detection device 5 enclosed in the housing 2 in substantially the same manner as in the embodiment shown in FIGS. 1 and 2. Between the housing 2 and the signal detection device 5, a heat release plate 21 is disposed through electrically insulating bushes 22 and secured to the housing 2 by means of screws 20, so that the heat release plate 21 is electrically isolated from the housing 2.

With this construction, heat generated in various electrical devices, such as the signal detection device 5 and the ignition coil 7, is released through the heat release plate 21.

Figure 5:
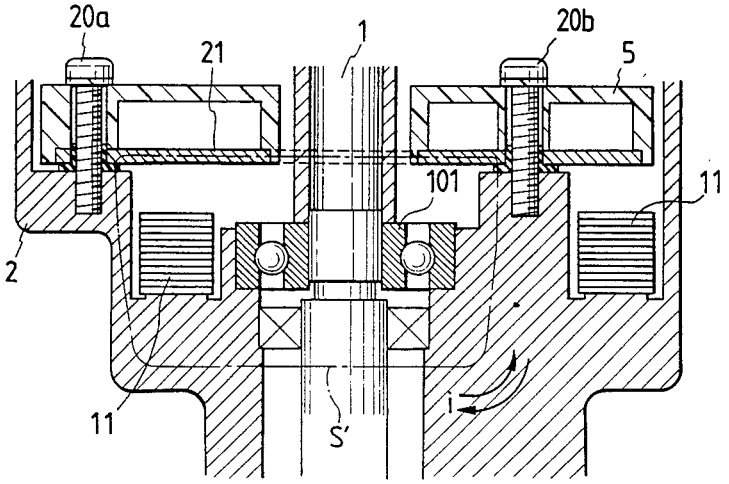
FIG. 5 is a sectional view of the distributor taken along a line V—V of FIG. 4*a;*
Figure 6:
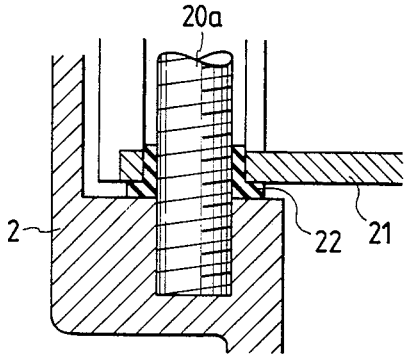
FIG. 6 is an enlarged view of a part of the distributor shown in FIG. 5.

If the electrically insulating bushes 22 are not provided, a short circuit is establish through the heat release plate 21 and the housing 2, as shown by S in FIG. 5 and resistance heat due to an electrical current flowing in the short circuit S by magnetic induction of the ignition coil 12 is generated. However, in this embodiment, the electrically insulating bushes 22 provided in the short circuit S breaks the short circuit S so that no electrical current flows in the short circuit S. This also contributes to heat reduction and provision of a reliable distributor.

Another embodiment of the present invention will be described with reference to FIGS. 7 and 8.

Figure 7:
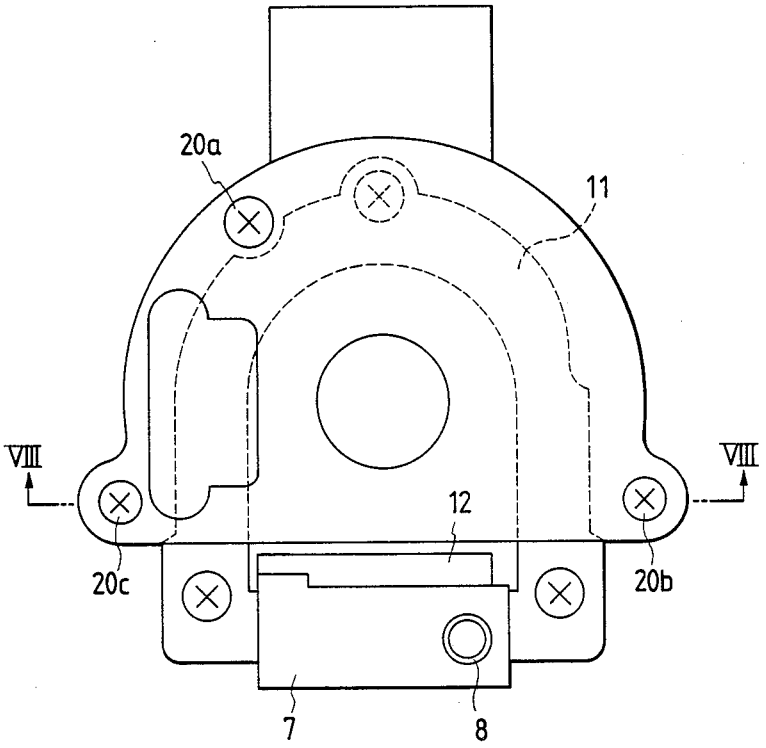
FIG. 7 is a plane view of another embodiment of a distributor for an internal combustion engine according to the present invention.
Figure 8:
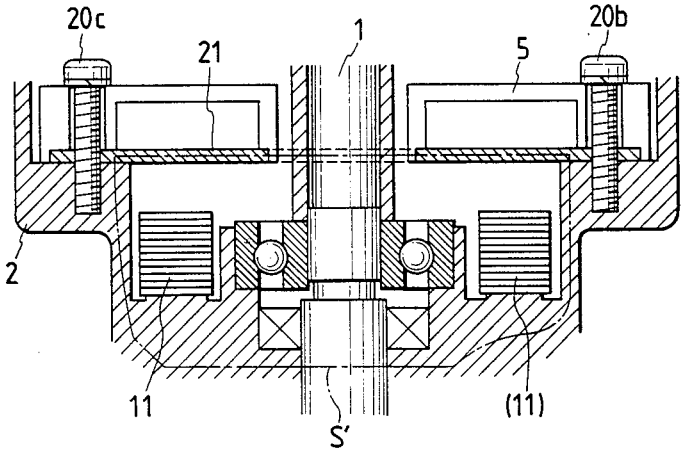
FIG. 8 is a sectional view of the distributor taken along a line VIII—VIII of FIG. 7.

A distributor shown in FIGS. 7 and 8 differs from the previous embodiment in that fastening screws for fastening the heat release plate 21 to the housing 2 are all disposed outside the annular core 11 of the ignition coil 7 so that a short circuit through the heat release plate 21 and the housing 2 encloses two sections of the core 11, and in that the electrically insulating bushes 22 are not provided as mentioned above.

In this embodiment, the heat release plate 21 is secured outside the core 11. In this arrangement, although the core 11 is surrounded by electrically conductive members, the directions of two magnetic fluxes extending through the core 11 are opposite to each other in a cross-sectional view and, therefore, even if a short-circuit S' is formed, no current can flow therein.

By virtue of this arrangement, it is unnecessary to provide the insulating bushes 22 shown in FIG. 5 and the heat release plate 21 is secured directly to the housing 2 at three points (or two or more points); therefore, the heat release effect is enhanced.

A further embodiment of the invention will be described hereunder in detail referring to FIG. 9.

Figure 9:
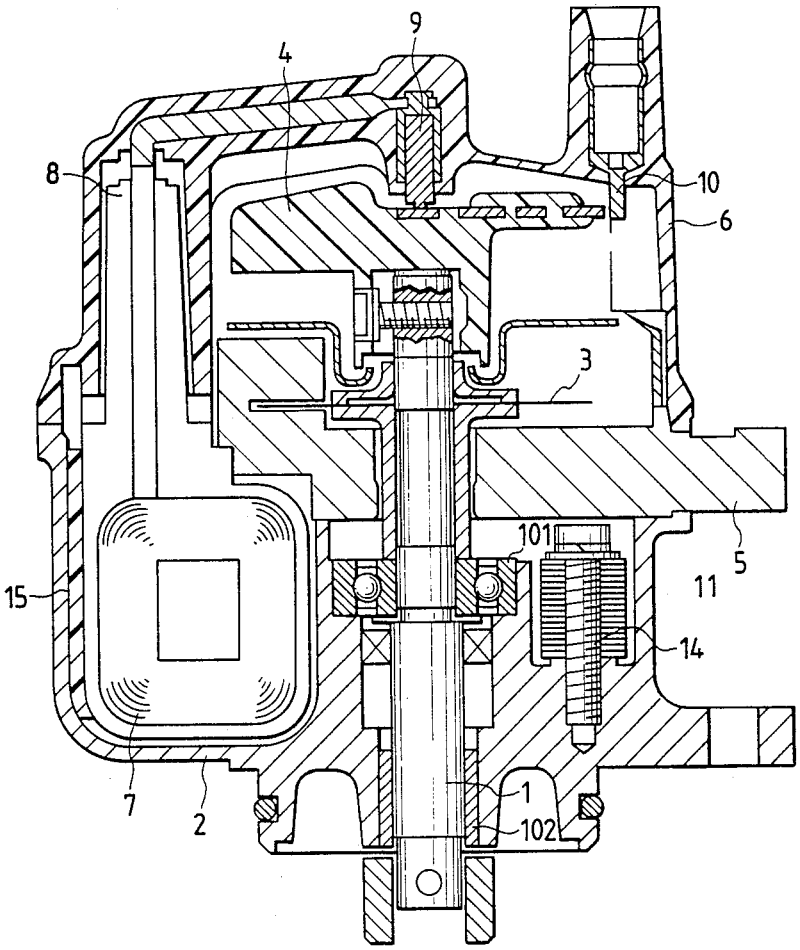
FIG. 9 is a longitudinal sectional view of another embodiment of a distributor for an internal combustion engine according to the present invention.

In FIG. 9, a shaft 1 rotates synchronously with the rotation of the engine (not shown), so that an intermittent signal is generated by the signal rotor 3 in the form of a signal representative of a crank angle position of the engine to be transferred to a controller (not shown) through the signal detector 5. Further, by receiving an optimal engine ignition timing signal, the ignition coil 7 induces a high voltage. The induced high voltage is supplied to the rotor head 4 from the coil electrode 8 through a cap central electrode 9 and is then discharged from the rotor head 4 toward a cap-side electrode 10, thus applying a high voltage to the ignition plug attached to each cylinder (not shown) of the engine.

When a high voltage is generated from the ignition coil 7, heat is also generated simultaneously.

In order to transfer the generated heat to the housing 2, a material having a high thermal conductivity (e.g., a silicon rubber) is charged in the gap between the ignition coil 7 and the housing 2. As the filler, a fluid material which can be solidified is conveniently employed. A material which has high electrical insulating properties is preferable. From these points of view, silicon rubber is suitably employed.

Figure 10:
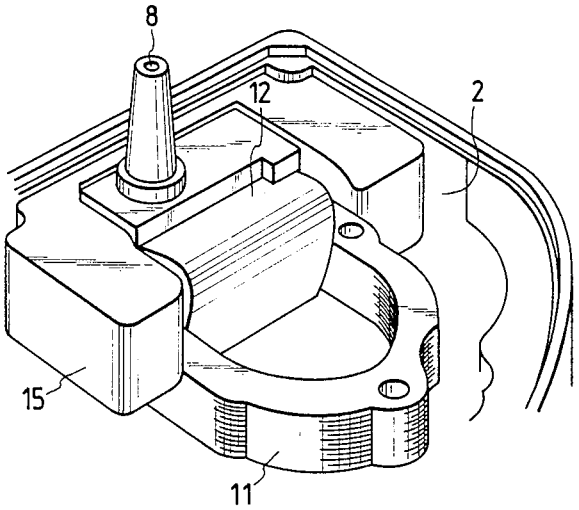
FIG. 10 is a perspective view of a part of the distributor in FIG. 9.

FIG. 10 shows silicon rubber 15 charged in the gap between the ignition coil 7 and the housing 2.

As shown in FIG. 10, the silicon rubber 15 is filled in between the housing 2 and the core 11 so as to enclose the core 11 in a U-shape. The height of the silicon rubber 15 is equal or greater than the diameter of the coil, as seen in FIGS. 9 and 10.

Figure 11:
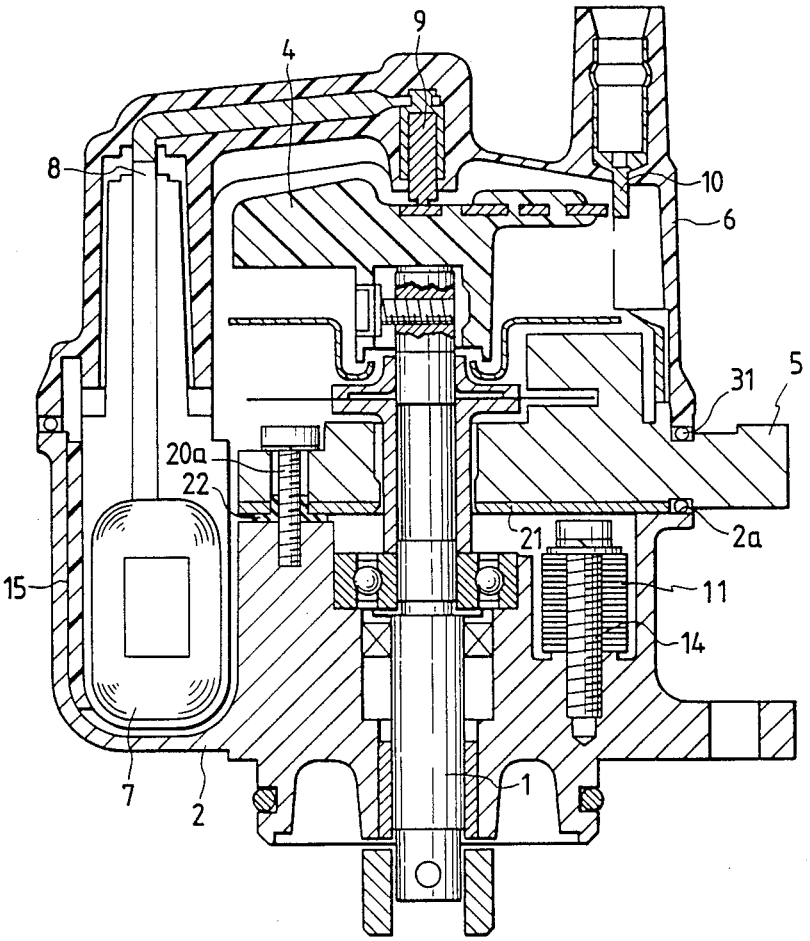
FIG. 11 is a longitudinal sectional view of another embodiment of a distributor according to the present invention.

FIG. 11 shows a distributor in which an ignition coil is incorporated in a housing and a heat release plate and electrically insulating bushes are provided.

In FIG. 11, the rotor shaft 1 is mounted on the housing 2, and provided with a signal rotor 3 and is a rotor head 4. In the housing 2, the ignition coil 7 is disposed so that the core 11 surrounds the bearing portion of the shaft 1, and is fixed to the housing 2 by fastening screws 14. The housing 2 has an open upper end at which a notch is formed for receiving a gasket 31 consisting of a large diameter portion and a small diameter portion as shown in FIG. 2, and a part of the side wall of the housing 2 is cut-out as in FIG. 2 to form a cut-out portion **2*a*, the periphery of which is formed with a notch for receiving a part of the gasket 31 as in FIG. 2. The gasket 31 has a large-diameter portion fitted in the notch of the open upper end of the housing and a small-diameter portion extending perpendicularly to a place on which the large-diameter portion is disposed. In the small diameter portion of the gasket 31, the connector 5*a* of the signal detection device 5 is inserted, and the signal detection device 5 is mounted on the housing together with the gasket 31 after the heat release plate 21 and the electrically insulating bushes 22 are disposed and fastened by fastening screws. A cap 6 having a central electrode 9 and a side electrode 10 is set on the gasket 31 and is pressed by fastening screw 20*a* whereby sealing of the housing 2 is completed. In a gap formed between the side wall of the housing 2 and the ignition coil 7, a material 15 of excellent heat conductivity, such as silicon rubber, is inserted to release the heat generated in the ignition coil 7 through the material 15** and the side wall.

The distributor for an internal combustion engine having a sealing means as disclosed in FIGS. 1 to 3 is easy to assemble and provides superior water tightness. Hence it is possible with such construction to provide improvements in the reliability and durability of electrical parts accommodated in the distributor.

In the distributor for an internal combustion engine according to this invention it is possible to prevent generation of heat due to electromagnetic induction caused by the ignition coil and, hence it is possible to provide improvements in the durability and reliability of electrical parts accommodated in the distributor.

In a distributor for an internal combustion engine provided with a heat release plate in the manner described above, it is possible to promote dissipation of heat generated from the ignition coil and, hence, to provide improvements in the reliability and durability of electrical parts accommodated in the distributor by providing a material of excellent heat conductivity between the housing and the ignition coil.

Thus, the the various features of the invention together enable improvements in the resistance to environmental changes of electrical parts accommodated in the distributor and exhibit the great practical advantage that it is possible to support advances in technological progress, i.e., accommodation of electrical parts in the distributor.

What is claimed is:

1. A distributor for an internal combustion engine, comprising: a housing having a bottom an open end and a side wall between said bottom and said open end; a shaft inserted in said housing and mounted to rotate and be driven synchronously with an engine crankshaft; a rotor head mounted on said shaft; a cap attached to said housing so as to cover said rotor head; and a signal detector accommodated in said housing and having a connector projecting outside said housing; said housing having a cut-out portion formed in said side wall so as to extend toward said bottom of said housing from said open end for receiving said connector, and a gasket having a smaller part surrounding said connector and fitted in said cut-out portion of said housing and a larger part disposed on said open end and pressed between said housing and said cap, whereby a sealing around said connector and an abutment between said housing and said cap is formed.

2. A distributor for internal combustion engine according to claim 1, wherein said larger part of said gasket has an annular shape and said smaller part extends from a part of said larger part perpendicularly to a plane on which said larger part is disposed and also has an annular shape, said connector being loosely inserted in said smaller part and pressed by said cap and said housing so that said connector is waterproofed.

3. A distributor for an internal combustion engine according to claim 1, wherein said cut-out portion has side faces spaced by a distance which is narrowed from said open end toward said bottom, said connector being surrounded by said smaller part of said gasket and inserted in said cut-out portion and pressed on a bottom of said cut-out portion by said cap through said gasket.

4. A distributor for an internal combustion engine, comprising: a housing; a shaft inserted in said housing and mounted to rotate and be driven synchronously with an engine crankshaft; a rotor head mounted on said shaft; a cap attached to said housing so as to cover said rotor head: a signal detector accommodated in said housing; a connector attached to said signal detector so as to project outside said housing; and an ignition coil accommodated in said housing; said housing having a cut-out portion formed in a side wall thereof from an abutment between said cap and said housing and extending toward a bottom of said housing for receiving said connector, said cap and said connector being tightly engaged with said housing through a gasket, and a material having good thermal conductivity which is charged in a gap between said housing and said ignition coil.

5. A distributor for an internal combustion engine according to claim 4, wherein said material having good thermal conductivity is a silicon rubber having fluidity, said silicon rubber being poured and solidified in said gap.

6. A distributor for an internal combustion engine, comprising: a housing; a shaft inserted in said housing and mounted to rotate and be driven synchronously with an engine crankshaft; a rotor head mounted on said shaft; a cap attached to said housing so as to cover said rotor head; a signal detector accommodated in said housing; a connector attached to said signal detector so as to project outside said housing; an ignition coil accommodated in said housing, said ignition coil having an annular core disposed around said shaft; a heat release plate disposed on said housing so that an electrical current path around a part of said core is formed by said heat release plate and said housing; said housing having a cut-out portion formed in a side wall thereof an extending from an abutment between said cap and said housing toward a bottom of said housing for receiving said connector, said cap and said connector being tightly engaged with said housing through a gasket; and means for interrupting electrical current flow in said electrical current path.

7. A distributor for an internal combustion engine according to claim 6, wherein said interrupting means is an electrically insulating bushing disposed between said heat release plate and said housing.

8. A distributor for an internal combustion engine according to claim 6, wherein said electrical current path is disposed to surround two magnetic flux paths of said core so that no induction current is induced in said electrical path, thereby providing said means for interrupting electric current flow in said electric current path.

9. A distributor for an internal combustion engine according to claim 6, wherein said material having good thermal conductivity is a silicon rubber having fluidity, said silicon rubber being poured and solidified in said gap.

10. A distributor for an internal combustion engine according to claim 6, wherein said gasket has a smaller part surrounding said connector and fitted in said cut-out portion of said housing and a larger part disposed on an open end of said housing and pressed between said housing and said cap.

11. A distributor for internal combustion engine according to claim 10, wherein said larger part of said gasket has an annular shape and said smaller part extends from a part of said larger part perpendicularly to a plane on which said larger part is disposed and also has an annular shape, said connector being loosely inserted in said smaller part and pressed by said cap and said housing so that said connector is waterproofed.

12. A distributor for an internal combustion engine according to claim 10, wherein said cut-out portion has side faces spaced by a distance which is narrowed from said open end toward said bottom, said connector being surrounded by said smaller part of said gasket and inserted in said cut-out portion and pressed on a bottom of said cut-out portion by said cap through said gasket.

* * * * *